US012649991B2

(12) United States Patent
Chen Chuang

(10) Patent No.: US 12,649,991 B2
(45) Date of Patent: Jun. 9, 2026

(54) PULP MOLDED CONTAINER AND FABRICATING METHOD THEREOF

(71) Applicant: INTLPAK ENTERPRISES CORPORATION, Nantou City (TW)

(72) Inventor: Su-Chu Chen Chuang, Taichung City (TW)

(73) Assignee: INTLPAK ENTERPRISES CORPORATION, Nantou City (TW)

( * ) Notice: Subject to any disclaimer, the term of this patent is extended or adjusted under 35 U.S.C. 154(b) by 357 days.

(21) Appl. No.: 18/341,883

(22) Filed: Jun. 27, 2023

(65) Prior Publication Data

US 2024/0003094 A1 Jan. 4, 2024

(30) Foreign Application Priority Data

Jun. 30, 2022 (TW) ..... 111124630

(51) Int. Cl.
*D21J 3/10* (2006.01)
*D21H 11/00* (2006.01)

(52) U.S. Cl.
CPC ..... *D21J 3/10* (2013.01); *D21H 11/00* (2013.01)

(58) Field of Classification Search
CPC ..... D21H 11/00; D21J 3/10
See application file for complete search history.

(56) References Cited

U.S. PATENT DOCUMENTS

| | | | | |
|---|---|---|---|---|
| 10,377,547 | B2 | 8/2019 | Chung et al. | |
| 2003/0121635 | A1* | 7/2003 | Kumamoto | D21J 3/10 162/227 |
| 2021/0017712 | A1* | 1/2021 | Nelson | D21H 11/18 |
| 2021/0054569 | A1* | 2/2021 | Uehara | D21H 27/10 |

FOREIGN PATENT DOCUMENTS

| | | | |
|---|---|---|---|
| CN | 2496913 | Y | 6/2002 |
| CN | 1566527 | A | 1/2005 |
| CN | 111304967 | A | 6/2020 |
| CN | 111511989 | A | 8/2020 |
| CN | 109972443 | B | 9/2020 |
| CN | 114411442 | A | 4/2022 |
| JP | H09078500 | A | 3/1997 |
| JP | 2007126757 | A | 5/2007 |
| JP | 2012158160 | A | 8/2012 |
| JP | 2019119938 | A | 7/2019 |
| JP | 2019527779 | A | 10/2019 |
| JP | 2020165022 | A | 10/2020 |

* cited by examiner

*Primary Examiner* — Larry W Thrower
(74) *Attorney, Agent, or Firm* — CKC & Partners Co., LLC

(57) ABSTRACT

A fabricating method of a pulp molded container includes providing a main material, performing a dispersing step, performing a pulping step, performing an additive adding step, and performing a heat compression molding step. The main material includes a long fiber pulp and a short fiber pulp. In the dispersing step, the main material is dispersed evenly in water to form an aqueous pulp solution. In the pulping step, the aqueous pulp solution is mechanically fibrillated to form a fibrillated pulp. In the additive adding step, an additive is added into the fibrillated pulp and mixed to form a paper pulp. In the heat compression molding step, the paper pulp is formed into the pulp molded container by heat compression molding.

8 Claims, 2 Drawing Sheets

PULP MOLDED CONTAINER AND FABRICATING METHOD THEREOF

RELATED APPLICATIONS

This application claims priority to Taiwan Application Serial Number 111124630, filed Jun. 30, 2022, which is herein incorporated by reference.

BACKGROUND

Technical Field

The present disclosure relates to a pulp molded container, and a fabricating method thereof. More particularly, the present disclosure relates to a pulp molded container with a hot oil resistance, controllable low air permeance and a sealability, and a fabricating method thereof.

Description of Related Art

As the concept of environmental protection continues to be valued by countries, the global promotion of bio-renewable energy, decomposable and recycled materials, and the reduction of the use of plastic products have become a common goal of many countries. However, in food-related fields, plastic containers are still often used to contain food, because plastic has good gas barrier, hot oil resistance, heat sealing and waterproof, and the price thereof is cheap. Currently, there are no other materials other than plastic that can meet the above requirements, so that the packaging containers for the ready-to-eat food used in microwave ovens on the market are all made of plastic containers.

Although there are many pulp molded containers on the current market for short-term storage of food, the common pulp molded containers have relatively poor gas barrier and poor oil resistance. Therefore, it is difficult to maintain the oil resistance when the common pulp molded containers are used in the ovens or the microwave ovens, and the common pulp molded containers are still limited in terms of food packaging. The ready-to-eat food packaging containers in convenience food stores and supermarkets are in great demand and are disposable. Due to the complex performance requirements of the demand, the pulp molded products have not yet been used for the demand. Furthermore, the existing pulp molded containers cannot be heat-sealed to prevent contamination, and cannot be used to contain ready-to-eat foods for a long time on the market. The current improved method is to paste a layer of plastic film on the pulp molded container, but the plastic content of this method is still high and the material is expensive, which also causes the problem that it is not easy to recycle.

Due to the freshness requirement of the ready-to-eat food, the shelf life thereof is usually 2~10 days. The packaging design of the ready-to-eat food can be separated from the need to use barrier packaging containers such as metal, glass, plastic and paper composite. It is possible to develop the pulp molded container by directly adding a small amount of additive in the pulp process without increasing too much cost, so as to achieve the characteristics of oil resistance and low air permeance. Therefore, the sustainable requirements of environmental protection also can be met, so as to solve the current technical problem of preparing the containers for containing the ready-to-eat food with materials with environmental protection requirements.

Therefore, the development of a pulp molded container and a fabricating method thereof, in which the pulp molded container with good gas barrier and good hot oil resistance can be produced and can be used at high temperatures and meets environmental protection requirements, is important.

SUMMARY

According to one aspect of the present disclosure, a fabricating method of a pulp molded container including providing a main material, performing a dispersing step, performing a pulping step, performing an additive adding step, and performing a heat compression molding step. The main material includes a long fiber pulp and a short fiber pulp, wherein based on the main material being 100% by weight, the long fiber pulp is 1% by weight to 99% by weight. In the dispersing step, the main material is dispersed evenly in water to form an aqueous pulp solution. In the pulping step, the aqueous pulp solution is mechanically fibrillated to form a fibrillated pulp. In the additive adding step, an additive is added into the fibrillated pulp and mixed to form a paper pulp, wherein the additive includes a nanocellulose and/or a starch, and based on the main material 100% by weight, an added amount of the nanocellulose is 0.1% by weight to 30% by weight, and an added amount of the starch is 1% by weight to 50% by weight. In the heat compression molding step, the paper pulp is formed into a pulp molded container by heat compression molding.

According to another aspect of the present disclosure, a pulp molded container is provided. The pulp molded container is manufactured by the aforementioned fabricating method of the pulp molded container, and test seconds of a quantitative air permeance test of the pulp molded container increased by more than 20%.

BRIEF DESCRIPTION OF THE DRAWINGS

The present disclosure can be more fully understood by reading the following detailed description of the embodiment, with reference made to the accompanying drawings as follows.

DETAILED DESCRIPTION

Figure 1:
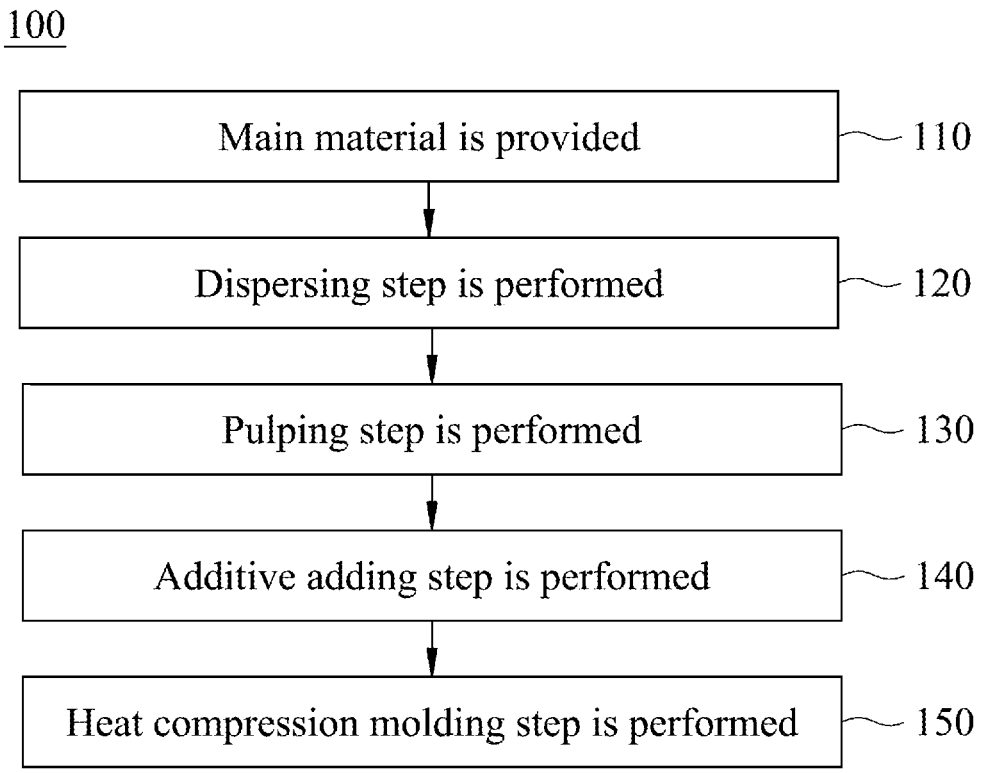
FIG. 1 is a flow chart showing a fabricating method of a pulp molded container according to one example of one embodiment of the present disclosure.

Reference will now be made in detail to the present embodiments of the present disclosure, examples of which are illustrated in the accompanying drawings. Wherever possible, the same reference numbers are used in the drawings and the description to refer to the same or like parts.

Reference is made to FIG. 1, which is a flow chart showing a fabricating method of a pulp molded container 100 according to one example of one embodiment of the present disclosure. The fabricating method of the pulp molded container 100 includes Step 110, Step 120, Step 130, Step 140 and Step 150.

Step 110 is providing a main material. In detail, the main material includes a long fiber pulp and a short fiber pulp, wherein based on the main material being 100% by weight, the long fiber pulp is 1% by weight to 99% by weight. Preferably, the long fiber pulp can be 10% by weight to 50% by weight. Generally speaking, long-fiber pulp mainly affects the tensile strength of the product, and short-fiber pulp mainly affects the uniformity of the product, so the desired product properties can be obtained by adjusting the ratio of the long fiber pulp and the short fiber pulp in the main material.

Step 120 is performing a dispersing step, wherein the main material is dispersed evenly in water to form an aqueous pulp solution.

Step 130 is performing a pulping step, wherein the aqueous pulp solution is mechanically fibrillated to form a fibrillated pulp. In detail, fibrillation refers to the occurrence of fuzzing, tearing, and splitting of the cell walls of the fibers contained in the aqueous pulp solution, thereby making the aqueous pulp solution soft and plastic, and improving the bonding force between the fibers. Specifically, in Step 130, the aqueous pulp solution can be pulped several times to make the freeness of the fibrillated pulp reach between 300 and 600, but the present disclosure is not limited thereto.

In greater detail, the freeness can be used to measure the drainage performance of pulp, and the freeness is related to the degree of pulp pulping. Therefore, the fabricating method of the pulp molded container 100 of the present disclosure can improve the freeness by pulping the aqueous pulp solution several times, so as to adjust the drainage performance of the fibrillated pulp.

Step 140 is performing an additive adding step, wherein a small amount of an additive is directly added into the fibrillated pulp and mixed to form a paper pulp. The paper pulp is low-cost and meets the requirements of mass production. The additive includes a nanocellulose and/or a starch, and based on the main material 100% by weight, an added amount of the nanocellulose is 0.1% by weight to 30% by weight, and an added amount of the starch is 1% by weight to 50% by weight. In detail, the nanocellulose has high mechanical strength, adjustable surface chemical properties, crystallinity, barrier properties and biodegradability, which can be a nano cellulose fibril (NCF), a cellulose nanocrystal (CNC) or a bacterial nanocellulose (BNC). The starch can be a natural starch or a modified starch, and the modified starch can be cationic starch or amphoteric starch. The properties of the hot oil resistance and the gas barrier of the pulp molded container can be achieved by subsequent control the degree of starch gelatinization.

In addition, the degree of starch gelatinization and the added amount of the starch and the nanocellulose are limited and cannot be added too much. Therefore, depending on the performance strength of the pulp molded container required, such as reducing the air permeance, improving the sealability and the easy openability or improving the hot oil resistance, the additive can further include an inorganic substance and/or a polymer, and the additive can also include oil repellant such as MF300. The inorganic substance can include calcium carbonate, bentonite, montmorillonite, shell powder (such as antibacterial shell powder), calcium silicate, kaolin, mica, borax, diatomaceous earth, apatite, talc, titanium dioxide, aluminum compound (such as aluminum sulfate, aluminum oxide, etc.) or a mixture thereof. The polymer does not include the nanocellulose and the starch, which can be a biodegradable polymer or a non-biodegradable polymer, and the biodegradable polymer includes oil-base synthetic polymers, biomass-based synthetic polymers, microbial fermentation polymers and natural polymers. In greater detail, the polymers can include poly-butyleneadipate-co-terephthalate (PBAT), polybutylene-succinate (PBS), polybutylene succinate adipate (PBSA), polycaprolactone (PCL), polyvinyl alcohol (PVA), polylactide (PLA), polyglycolic acid (PGA), poly-hydroxyoctanoate (PHO), poly-hydroxyalkanoates (PHA), poly-hydroxybutyrate (PHB), poly(3-hydroxybutyrate-co-3-hydroxyvalerate) (PHBV), p-hydroxybenzoic acid (PHBH), xanthan gum, cellulose derivative (such as carboxymethyl cellulose, methyl cellulose, hydroxypropyl cellulose, ethyl cellulose, or the source can be beer pomace or bagasse), animal glue (such as gelatin), vegetable glue (such as pectin, carrageenan, locust bean gum, alginate, rosin), chitin (such as chitosan), protein (such as whey protein, casein, albumin, soybean protein lysate), polyolefin fiber, maleic anhydride polymer, polyurethane (PU), wax slurry, poly(ethylene 2,5-furanoate) (PEF), water-based acrylic, alkyl ketene dimer (AKD), poly aluminum chlorohydrate (PAC) or a mixture thereof. In addition, based on the main material being 100% by weight, an added amount of the polymer can be 0.1% by weight to 20% by weight, and an added amount of the inorganic substance can be 1% by weight to 10% by weight.

In detail, the aforementioned additive is material with dense texture or fine particle, so the pulp molded container made of paper pulp containing the aforementioned additive has the hot oil resistance and low air permeance. The gaps in the pulp molded container that allow gas and grease to pass through are blocked by the fine particles of the aforementioned additive, resulting in a "bypass effect" when the gas or grease passes through the pulp molded container, that is, the gas or grease needs to go through a longer path to penetrate the pulp molded container. In addition, glue can also be used as a binder for pulp fibers to increase strength and reduce the cost of pulp raw materials. Therefore, the pulp molded container manufactured by the fabricating method of the pulp molded container 100 of the present disclosure can have excellent effects on the gas barrier and the hot oil resistance.

Step 150 is performing a heat compression molding step, wherein the paper pulp is formed into the pulp molded container by heat compression molding. In detail, the present disclosure is not limited to the appearance or structural design of the pulp molded container, as long as the structure thereof can effectively block gas and oil to contain food or liquid.

Figure 2:
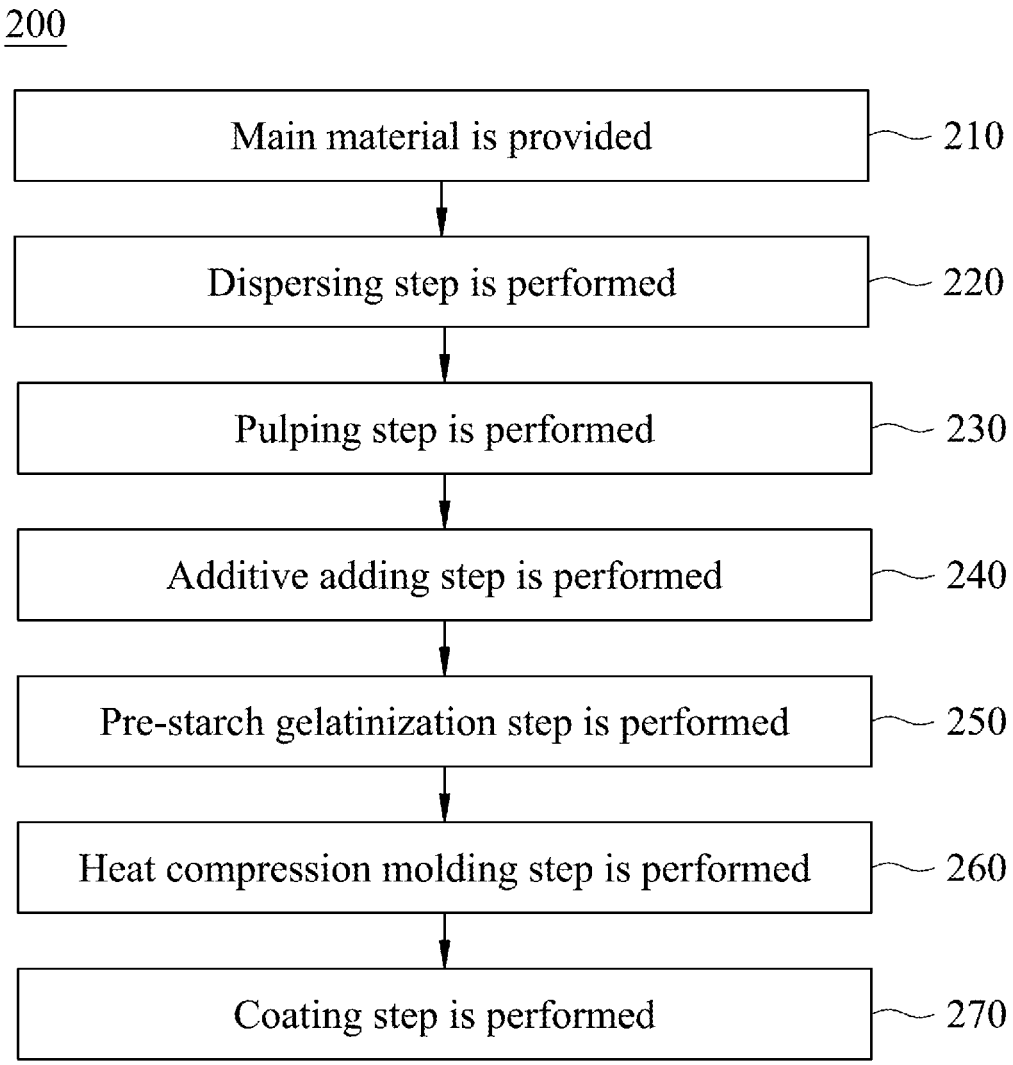
FIG. 2 is a flow chart showing a fabricating method of a pulp molded container according to another example of one embodiment of the present disclosure.

Reference is made to FIG. 2, which is a flow chart showing a fabricating method of a pulp molded container 200 according to another example of one embodiment of the present disclosure. The fabricating method of the pulp molded container 200 includes Step 210, Step 220, Step 230, Step 240, Step 250, Step 260 and Step 270, wherein Step 210, Step 220, Step 230 and Step 240 are the same as Step 110, Step 120, Step 130 and Step 140 of the fabricating method of the pulp molded container 100 in FIG. 1, and will not be repeated here.

Step 250 is performing a pre-starch gelatinization step, wherein the paper pulp obtained from Step 210 to Step 240 is preheated at a temperature greater than 100° C. for more than 1 second to obtain a pre-starch gelatinized paper pulp. The water content of the pre-starch gelatinized paper pulp processed in Step 250 is about 50%~90%. The pre-starch gelatinization step is a key technology, which affects the complete gelatinization degree and speed of the starch, and does not affect the demand for mass production. The preheating time and temperature will vary with different machines.

Step 260 is performing a heat compression molding step, wherein the pre-starch gelatinized paper pulp is hot-pressed at a temperature above 100° C. for more than 10 seconds to perform a gelatinization reaction and shaping, so as to obtain the pulp molded container. The pulp molded container can be further dried. The water content of the pulp molded container after the starch gelatinization is completely processed in Step 260 is about 5% to 10%.

Step 270 is performing a coating step, wherein a first coating agent and/or a second coating agent are coated on a surface of the pulp molded container. In detail, the first coating agent and the second coating agent respectively include calcium carbonate, bentonite, montmorillonite, shell powder (such as antibacterial shell powder), calcium silicate, kaolin, mica, borax, diatomaceous earth, apatite, talc, titanium dioxide, aluminum compound (such as aluminum sulfate, aluminum oxide, etc.), poly-butyleneadipate-co-terephthalate, polybutylene-succinate, polybutylene succinate adipate, poly-hydroxyoctanoate, polycaprolactone, polyvinyl alcohol, polylactide, polyglycolic acid, poly-hydroxyalkanoate, poly-hydroxybutyrate, poly(3-hydroxybutyrate-co-3-hydroxyvalerate), p-hydroxybenzoic acid, xanthan gum, starch, cellulose, cellulose derivative, animal glue, vegetable glue, chitin, protein, polyolefin fiber, maleic anhydride polymer, polyurethane, wax slurry, polyvinyl furanoate, water-based acrylic, alkyl ketene dimer, poly aluminum chlorohydrate or a mixture thereof, and the first coating agent and the second coating agent are the same or different. In addition, based on the main material being 100% by weight, a coating amount of the first coating agent is 0.1% by weight to 40% by weight, and a coating amount of the second coating agent is 0.1% by weight to 40% by weight.

Specifically, the first coating agent and the second coating agent have a dense structure after drying, so it is difficult for gas or liquid to penetrate through the coating formed by the first coating agent and/or the second coating agent, thereby further strengthening the effects on the gas barrier and the hot oil resistance of the pulp molded container.

According to another aspect of the present disclosure, a pulp molded container is provided. The pulp molded container is manufactured by the fabricating method of the pulp molded container 100 or the fabricating method of the pulp molded container 200. The additive block the micropores of the pulp molded container, so that the test seconds of the quantitative air permeance test of the pulp molded container increased by more than 20%. Preferably, when the additive in the additive adding step further includes the polymer and/or the inorganic substance, the additive blocks the micropores of the pulp molded container due to the bypass effect, thereby allowing the test seconds of the quantitative air permeance test of the pulp molded container are increased by more than 1.5 times. More preferably, when the fabricating method of the pulp molded container includes a coating step, the prepared pulp molded container includes a coating layer that can block the micropores of the pulp molded container, so that the test seconds of the quantitative air permeance test of the pulp molded container are increased by more than 32 times.

Specifically, please refer to the following Table 1 and Table 2. Table 1 shows the different formulations and/or fabricating processes of the pulp molded container of the present disclosure and Comparative Examples. Table 2 shows the different characteristic requirements that can be achieved by preparing the pulp molded container of the present disclosure for different formulations and/or fabricating processes, wherein Θ represents the result is excellent, O means the result is good, Δ means the result is fair, and x means the result is poor. Comparative Example 1 is a pulp molded container without the additive, Comparative Example 2 is a non-pulp molded paperboard container, and Comparative Example 3 is a plastic container as comparisons.

TABLE 1

| Number | Main material | additive/process |
|---|---|---|
| Formula of the present disclosure | | |
| 1 | long fiber pulp, short fiber pulp | nanocellulose |
| 2 | long fiber pulp, short fiber pulp | starch |
| 3 | long fiber pulp, short fiber pulp | nanocellulose, starch |
| 4 | long fiber pulp, short fiber pulp | nanocellulose, starch, polymer |
| 5 | long fiber pulp, short fiber pulp | nanocellulose, starch, inorganic substance |
| 6 | long fiber pulp, short fiber pulp | nanocellulose, starch, polymer, inorganic substance |
| 7 | long fiber pulp, short fiber pulp | nanocellulose, starch/including coating step |
| Comparative Example | | |
| 1 | long fiber pulp, short fiber pulp | — |
| 2 | non-pulp molded paperboard (coating plastic) | — |
| 3 | Plastic | — |

TABLE 2

| Number | Hot oil resistance | Gas barrier | Water barrier | Sealability and easy openability | Environmental friendly |
|---|---|---|---|---|---|
| Formula of the present disclosure | | | | | |
| 1 | Δ | Δ | Δ | x~Δ | Θ |
| 2 | Δ~○ | Δ | Δ | Δ~○ | Θ |
| 3 | ○ | Δ~○ | Δ~○ | x~○ | Θ |
| 4 | ○~Θ | ○ | ○ | ○ | ○~Θ |
| 5 | ○ | ○ | Δ~○ | x~○ | Θ |
| 6 | Θ | Θ | ○~Θ | ○ | ○~Θ |
| 7 | Θ | Θ | Θ | Δ~○ | Θ |
| Comparative Example | | | | | |
| 1 | x | x | Δ | x | Θ |
| 2 | ○~Θ | ○ | ○ | ○ | Δ |
| 3 | Θ | Θ | Θ | Θ | x |

The comparison results as shown in Table 2, the pulp molded container manufactured by the fabricating method of the pulp molded container of the present disclosure has the hot oil resistance, low air permeance, the sealability and the easy openability. Therefore, the pulp molded container of the present disclosure can be used to contain a ready-to-eat food, and the ready-to-eat food is stored in refrigeration or freezing and/or heated in a microwave oven or an oven. The fabricating method of the pulp molded container of the present disclosure can improve the strength and toughness of the pulp molded container by adding special additive. Therefore, the fabricating method of the pulp molded container of the present disclosure can be used to manufacture paper cups and/or paper cup lids, and the paper cups and paper cup lids are not easy to leakage due to deformation during opening and closing. In addition, due to the leakage of hot soup and oil liquid in ordinary paper containers, food delivery is packed in plastic bags. However, most plastic bags contain plasticizers and are not suitable for hot liquids. The pulp molded container of the present disclosure is suitable to contain food including hot soup and hot oil, and no need to use plastic bags, which is an environmentally friendly, safe and hygienic solution.

Example

In order to meet different characteristic requirements, the pulp molded containers of the present disclosure are manufactured with different formulations and/or fabricating processes in the following Example 1 to Example 8, and a conventional pulp molded container is used as a Comparative Example 1. Please refer to the following Table 3, which shows the composition of the additive of Examples and Comparative Example 1 of the pulp molded container of the present disclosure. In addition, based on the main material being 100% by weight, the long-fiber pulp contained in the main material used in each of the following Examples and Comparative Example 1 is 30% by weight, and the short-fiber pulp is 70% by weight, so as to avoid the influence of test results due to the different composition of the main material in each Example.

TABLE 3

| Group | Main material | Type of additive and weight percentage thereof (based on the main material is 100% by weight) | | additive adding/ coating |
|---|---|---|---|---|
| Example 1 | long fiber pulp, short fiber pulp | nanocellulose | 5 | additive adding |
| Example 2 | long fiber pulp, short fiber pulp | starch | 10 | additive adding |
| Example 3 | long fiber pulp, short fiber pulp | nanocellulose | 0.3 | additive adding |
| | | starch | 5 | |
| Example 4 | long fiber pulp, short fiber pulp | nanocellulose | 0.3 | additive adding |
| | | starch | 5 | |
| | | montmorillonite | 2 | |
| Example 5 | long fiber pulp, short fiber pulp | nanocellulose | 0.3 | additive adding |
| | | starch | 5 | |
| | | polyolefin | 0.4 | |
| Example 6 | long fiber pulp, short fiber pulp | nanocellulose | 0.3 | additive adding |
| | | starch | 5 | |
| | | polyolefin | 0.4 | |
| | | montmorillonite | 2 | |
| Example 7 | long fiber pulp, short fiber pulp | nanocellulose | 0.4 | coating |
| | | starch | 5 | |
| | | polyolefin | 0.4 | |
| | | montmorillonite | 2 | |
| Example 8 | long fiber pulp, short fiber pulp | nanocellulose | 0.4 | coating |
| | | starch | 5 | |
| | | polyolefin | 0.4 | |
| | | polyamine | 0.5 | |
| Comparative Example 1 | long fiber pulp, short fiber pulp | — | | — |

The aforementioned Example 1 to Example 8 and Comparative Example 1 are further subjected to hot oil resistance test, quantitative air permeance test and easy-opening pull test. The hot oil resistance test is based on the TAPPI557 standard to test the Kit value, and the method of INTLPAK ENTERPRISES CORPORATION is used to test oil penetration resistance temperature. Quantitative air permeance test is based on ASTM D726 and GB/T458 with Gurley air-resistance densometer. The easy-opening pull test is measured according to the method of ASTM D882. Please refer to Table 4 below, which shows results of the aforementioned tests for Example 1 to Example 8 and Comparative Example 1.

TABLE 4

| | Hot oil resistance test | | | |
|---|---|---|---|---|
| Group | Kit value | Temperature of hot oil × 30 minutes | Quantitative air permeance test (seconds) | Easy opening pull force value (g) |
| Example 1 | 8 | 80° C., no penetration | 56 | 50~200 |
| Example 2 | 8 | 80° C., no penetration | 58 | 50~300 |
| Example 3 | 8 | 80° C., no penetration | 70 | 50~300 |
| Example 4 | 8 | 80° C., no penetration | 80 | 50~300 |
| Example 5 | 8 | 100° C., no penetration | 105 | 50~1200 |
| Example 6 | 8 | 120° C., no penetration | 120 | 50~1200 |
| Example 7 | 8 | 150° C., no penetration | 650 | 50~1200 |
| Example 8 | 8 | 150° C., no penetration | more than 1000 | 50~1200 |
| Comparative Example 1 | 4 | 40° C., penetration | 30 | cannot be sealed |

The test results of the oil penetration resistance temperature in Table 4 show that even if the temperature of hot oil exceeding 80° C., the hot oil will not penetrate through the pulp molded container of the present disclosure. The test results show that the pulp molded containers manufactured by the fabricating method of the pulp molded container of the present disclosure have better hot oil resistance performance, and can be used to contain hot food or heat the contained food with a microwave oven or an oven. In addition, the test seconds of the quantitative air permeance test of the pulp molded container of each Example with the additive are higher than the test seconds of the quantitative air permeance teat of the pulp molded container of Comparative Example 1, which indicate that the pulp molded container manufactured by the fabricating method of the pulp molded container of the present disclosure has a better gas barrier effect, thereby maintaining the flavor of the packaged content. Furthermore, the pulp molded container manufactured by the fabricating method of the pulp molded container of the present disclosure have the characteristics of the sealability and the easy openability, so the pulp molded container can be sealed and packaged to prevent contamination, such as foreign matter and bacteria, of the packaged content.

In summary, the pulp molded container manufactured by the fabricating method of the pulp molded container of the present disclosure has excellent effects on the gas barrier and the hot oil resistance by adding the nanocellulose and/or the starch to the fibrillated pulp, or further adding the inorganic substance and/or the polymer that do not include the nanocellulose and the starch. The pulp molded container of the present disclosure can be used as a container for containing and preserving food or liquid, and can be used for heating in the microwave oven or the oven. Therefore, compared with the conventional pulp molded container, the pulp molded container of the present disclosure has better and wider application.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A fabricating method of a pulp molded container, comprising:

providing a main material comprising a long fiber pulp and a short fiber pulp, wherein based on the main material being 100% by weight, the long fiber pulp is 1% by weight to 99% by weight, and a length of the long fiber pulp is longer than a length of the short fiber pulp;

performing a dispersing step, wherein the main material is dispersed evenly in water to form an aqueous pulp solution;

performing a pulping step, wherein the aqueous pulp solution is mechanically fibrillated to form a fibrillated pulp;

performing an additive adding step, wherein an additive is added into the fibrillated pulp and mixed to form a paper pulp, the additive comprises a nanocellulose and/or a starch, and based on the main material 100% by weight, an added amount of the nanocellulose is 0.1% by weight to 30% by weight, and an added amount of the starch is 1% by weight to 50% by weight; and performing a heat compression molding step, wherein the paper pulp is formed into the pulp molded container by heat compression molding;

wherein the fabricating method of the pulp molded container further comprises performing a pre-starch gelatinization step before the heat compression molding step, and the paper pulp is preheated at a temperature greater than 100° C. for more than 1 second to obtain a pre-starch gelatinized paper pulp;

wherein in the heat compression molding step, the pre-starch gelatinized paper pulp is hot-pressed at a temperature above 100° C. for more than 10 seconds to perform a gelatinization reaction and shaping, so as to obtain the pulp molded container.

2. The fabricating method of the pulp molded container of claim 1, wherein the nanocellulose is a nano cellulose fibril, a cellulose nanocrystal or a bacterial nanocellulose, and the starch is a natural starch or a modified starch.

3. The fabricating method of the pulp molded container of claim 1, wherein the additive further comprises an inorganic substance and/or a polymer, and the polymer does not comprise the nanocellulose and the starch.

4. The fabricating method of the pulp molded container of claim 3, wherein the inorganic substance comprises calcium carbonate, bentonite, montmorillonite, shell powder, calcium silicate, kaolin, mica, borax, diatomaceous earth, apatite, talc, titanium dioxide, aluminum compound or a mixture thereof, and the polymer comprises poly-butyleneadipate-co-terephthalate, polybutylene-succinate, polybutylene succinate adipate, poly-hydroxyoctanoate, polycaprolactone, polyvinyl alcohol, polylactide, polyglycolic acid, poly-hydroxyalkanoate, poly-hydroxybutyrate, poly(3-hydroxybutyrate-co-3-hydroxyvalerate), p-hydroxybenzoic acid, xanthan gum, cellulose derivative, animal glue, vegetable glue, chitin, protein, polyolefin fiber, maleic anhydride polymer, polyurethane, wax slurry, polyvinyl furanoate, water-based acrylic, alkyl ketene dimer, poly aluminum chlorohydrate or a mixture thereof.

5. The fabricating method of the pulp molded container of claim 4, wherein based on the main material being 100% by weight, an added amount of the inorganic substance is 1% by weight to 10% by weight, and an added amount of the polymer is 0.1% by weight to 20% by weight.

6. The fabricating method of the pulp molded container of claim 1, further comprising performing a coating step, wherein a first coating agent and/or a second coating agent is coated on a surface of the pulp molded container.

7. The fabricating method of the pulp molded container of claim 6, wherein the first coating agent and the second coating agent respectively comprise calcium carbonate, bentonite, montmorillonite, shell powder, calcium silicate, kaolin, mica, borax, diatomaceous earth, apatite, talc, titanium dioxide, aluminum compound, poly-butyleneadipate-co-terephthalate, polybutylene-succinate, polybutylene succinate adipate, poly-hydroxyoctanoate, polycaprolactone, polyvinyl alcohol, polylactide, polyglycolic acid, poly-hydroxyalkanoate, poly-hydroxybutyrate, poly(3-hydroxybutyrate-co-3-hydroxyvalerate), p-hydroxybenzoic acid, xanthan gum, starch, cellulose, cellulose derivative, animal glue, vegetable glue, chitin, protein, polyolefin fiber, maleic anhydride polymer, polyurethane, wax slurry, polyvinyl furanoate, water-based acrylic, alkyl ketene dimer, poly aluminum chlorohydrate or a mixture thereof, and the first coating agent and the second coating agent are the same or different.

8. The fabricating method of the pulp molded container of claim 6, wherein based on the main material being 100% by weight, a coating amount of the first coating agent is 0.1% by weight to 40% by weight, and a coating amount of the second coating agent is 0.1% by weight to 40% by weight.

* * * * *